US009675840B2

(12) United States Patent
Walstead, Jr.

(10) Patent No.: US 9,675,840 B2
(45) Date of Patent: Jun. 13, 2017

(54) SYSTEM FOR HORIZONTALLY SUSPENDING A RUNNING/WALKING SURFACE OVER AIR

(71) Applicant: William James Walstead, Jr., Baytown, TX (US)

(72) Inventor: William James Walstead, Jr., Baytown, TX (US)

( * ) Notice: Subject to any disclaimer, the term of this patent is extended or adjusted under 35 U.S.C. 154(b) by 0 days.

(21) Appl. No.: 14/824,309

(22) Filed: Aug. 12, 2015

(65) Prior Publication Data

US 2017/0043209 A1 Feb. 16, 2017

(51) Int. Cl.
*A63B 22/02* (2006.01)
*A63B 22/00* (2006.01)
*A63B 23/04* (2006.01)

(52) U.S. Cl.
CPC ..... *A63B 22/0285* (2013.01); *A63B 22/0046* (2013.01); *A63B 23/0405* (2013.01)

(58) Field of Classification Search
CPC ..... A63B 21/00; A63B 21/02
USPC ..... 482/26, 27, 71, 77
See application file for complete search history.

(56) References Cited

U.S. PATENT DOCUMENTS 3,689,066 A * 9/1972 Hagen ..... A63B 22/02 198/811
4,569,515 A * 2/1986 Gordon ..... A63B 5/11 273/401
4,708,338 A * 11/1987 Potts ..... A63B 21/023 482/52
4,938,473 A * 7/1990 Lee ..... A63B 22/02 482/27

* cited by examiner

*Primary Examiner* — Jerome w Donnelly
(74) *Attorney, Agent, or Firm* — Plager Schack LLP

(57) ABSTRACT

Some embodiments of the present disclosure include a system for rotatably and horizontally suspending a running/walking surface over air without being supported by a deck and a treadmill including the same. The system may include a belt rotationally suspended between a pair of rails, the belt configured to support a user; a plurality of pairs of grommets spaced along a length of the belt proximate to an edge of the belt; a bracket attached to a corresponding pair of grommets by a cable, wherein the bracket and the pair of grommets are positioned in a triangular relationship; a transporter bolt extending from the bracket; and a roller rotatably attached to the transporter bolt, wherein the roller is configured to engage with the rail.

8 Claims, 4 Drawing Sheets

SYSTEM FOR HORIZONTALLY SUSPENDING A RUNNING/WALKING SURFACE OVER AIR

BACKGROUND

The embodiments herein relate generally to rehabilitation and fitness equipment, and more particularly, to a treadmill system for horizontally suspending a flexible running/walking surface over air.

Conventional treadmills include a running surface (belt) being supported by being pulled over a hard deck. Thus, when a user runs or walks on the belt, the user's heel contacts/impacts both the belt and the deck. The collision of a user's heel with the supporting deck causes trauma to not only the heel, but also to the user's other joints and skeletal system, resulting in pain and risk of further injury. Conventional treadmills that are designed to suspend a running surface over air have had failure of the suspension components, such as ripped running surfaces, broken cables, broken brackets, wallowed out rollers, and the like, because they are not designed to withstand the amount of horizontal force required to suspend a user over air.

Therefore, what is needed is a system for horizontally suspending a running/walking surface over air, thus eliminating heel strike impact. For exercising runners on pavement or other hard surfaces, including traditional treadmills, providing a trampoline-like walking/running surface may not only prevent impact damage to the body, but may also provide a significantly greater cardiovascular workout, particularly as the surface is elevated, which creates a workout similar to running up a sand dune. For rehabilitating patients, the absence of pain caused by heel strike impact may allow the patient to begin walking earlier, reducing the atrophy period between injury and rehabilitation, which is frequently spent in a wheelchair. The inactivity during this time period can cause decay of body conditioning, which must be rebuilt in subsequent rehabilitation, elongating the time and cost of rehabilitation.

SUMMARY

Some embodiments of the present disclosure include a suspension system for horizontally suspending a running/walking surface over air and a treadmill including the same. The system may include a flexible belt rotationally suspended between a pair of rails, the belt configured to support a user while walking, running, jogging, standing, or the like; a plurality of pairs of grommets spaced along a length of the belt proximate to an edge of the belt; a bracket attached to a corresponding pair of grommets by a cable, wherein the bracket and the pair of grommets are positioned in a triangular relationship; a transporter bolt extending from the bracket; and a roller rotatably attached to the transporter bolt, wherein the roller is configured to engage with the rail. The suspension system may be configured to provide sufficient horizontal force (for example, up to 2000 pounds) to suspend a user.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used to horizontally suspend a running/walking surface over air and may comprise the following elements: (1) running/walking surface; (2) grommets; (3) bracket; (4) cable; (5) transporter bolt; (6) rail; and (7) roller. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

The various elements of the system for horizontally suspending a running/walking surface over air of the present disclosure may be related in the following exemplary fashion. It is not intended to limit the scope or nature of the relationships between the various elements and the following examples are presented as illustrative examples only.

By way of example, and referring to FIGS. 1-8, some embodiments of the present disclosure comprise a system for horizontally suspending a walking/running surface (belt 72) over air, wherein the belt 72 is configured to rotate around a pair of rails 74 without a deck being used to support or guide the belt 72. Thus, some embodiments of the present disclosure comprise a deckless treadmill having a horizontally suspended belt 72 that is configured to support a user while walking, jogging, running, standing, or the like, wherein the belt 72 is suspended over air.

Figure 1:
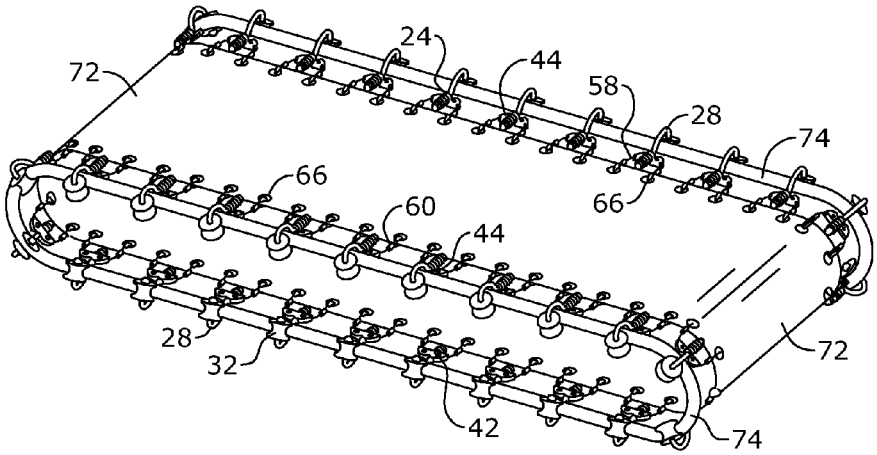
FIG. 1 is a perspective view of one embodiment of the present disclosure, shown in use.
Figure 2:
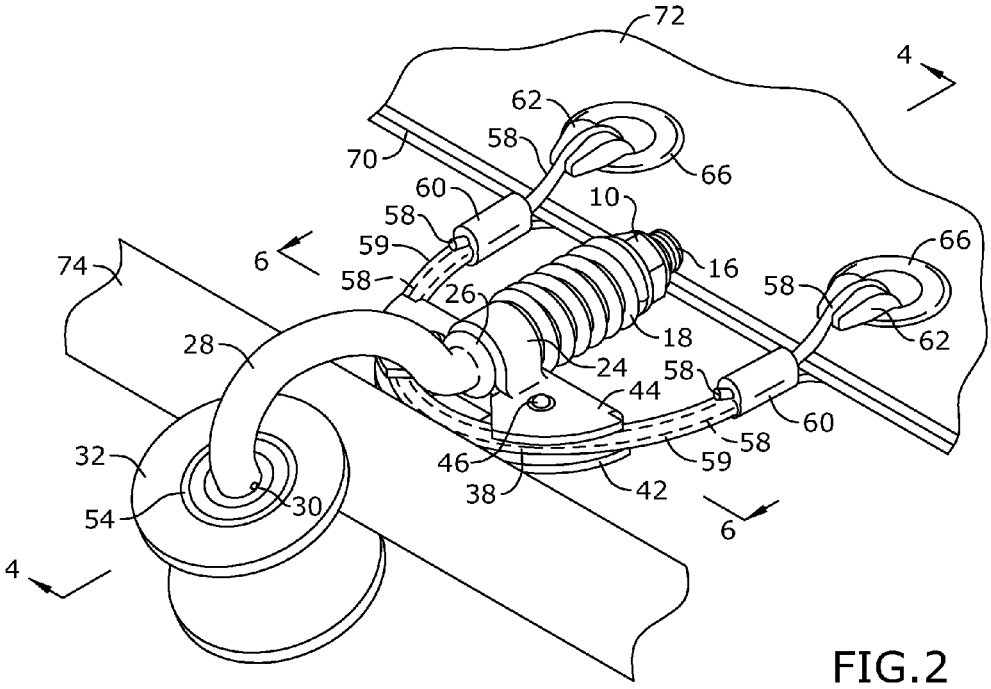
FIG. 2 is a perspective view of one embodiment of the present disclosure.
Figure 3:
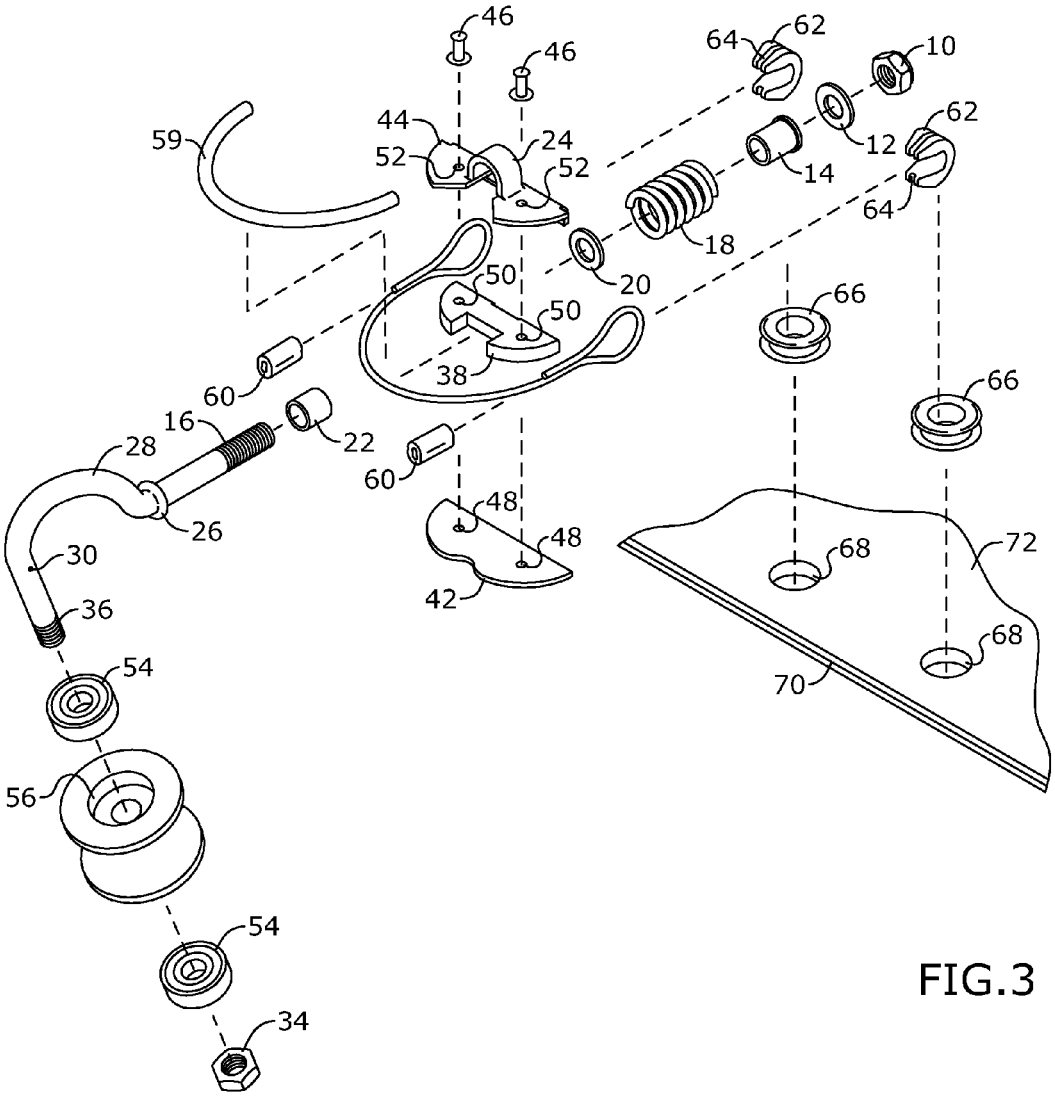
FIG. 3 is an exploded view of one embodiment of the present disclosure.

As shown in FIG. 1, which removes most conventional treadmill components (motor, etc.) for clarity, some embodiments of the system comprise a belt 72 rotationally suspended between a pair of rails 74, a plurality of pairs of grommets 66 spaced along a length of the belt 72 proximate to an edge of the belt 72, wherein each pair of grommets 66 is configured to attach to a bracket by a cable 58, a transporter bolt 28 extending from the bracket, and a roller 32 rotatably attached to the transporter bolt 28, wherein the roller 32 is configured to engage with the rail 74. As a result of this system, the user may be able to run, walk, jog, or stand on the belt 72 without worrying about impacting a hard surface, preventing numerous injuries to the body and allowing rehabilitative exercises to begin earlier and proceed more intensely than conventionally available treadmills.

Embodiments of the system include a device for attaching the belt 72 to the rail 74, such that the belt 72 is configured to rotate about the rail 74. An exemplary embodiment of this device is shown in FIGS. 2-7. As shown in the figures, the exemplary device may be attached to a pair of grommets 66 positioned on the belt 72, wherein each grommet 66 is positioned within a corresponding grommet orifice 68 on the belt 72. A cable 58 may have a first end and a second end, wherein the first end may pass through a first grommet 66 and the second end may pass through a second grommet 66, wherein each of the ends is formed into a loop. For example, the loops may be formed by a cable crimp 60 attaching the end of the cable 58 to a portion of the cable closer to the center of the cable 58. In some embodiments, a cable guide or saddle 62 may be positioned within each grommet 66, wherein each saddle 62 comprises a cable groove 64, such as a substantially or perfectly circular cable groove 64, configured to accommodate the cable 58, the saddle 62 being configured to ensure that the cable 58 follows a substantially circular path to insulate the cable 58 from a sharp junction or kink that may be formed by the grommet 66.

A central portion of the cable 58 may engage with a bracket, wherein the bracket comprises a bracket insert 38 sandwiched between a top bracket portion 44 and a lower bracket portion 42. The bracket may be held together using any suitable fastener. In some embodiments, the bracket may be held together by a pair of rivets 46, wherein the rivets 46 are each configured to pass through a respective upper bracket rivet orifice 52, bracket insert rivet orifice 50, and lower bracket rivet orifice 48, securing the bracket insert 38 between the upper bracket portion 44 and the lower bracket portion 42. Extending from the upper bracket portion 44, such as at a centrally located region of the upper bracket portion 44, may be positioned a bracket hood 24. The bracket hood 24 may define an orifice through which a portion of a transporter bolt 28 may pass.

As shown in the Figures, the transporter bolt 28 may have a substantially straight portion and a rounded hook portion extending from the substantially straight portion, wherein a bolt stop ridge 26 may define the demarcation between the substantially straight portion and the rounded hook portion. An end of the substantially straight portion distal from the hooked portion may comprise forward end bolt threads 16, and an end of the hooked portion distal from the substantially straight portion may comprise rear bold threads 36.

The substantially straight portion of the transporter bolt 28, including the forward bolt threads 16, may pass through the bracket hood 24, wherein the remainder of the bolt 28 may be prevented from passing through the bracket hood 24 by the bolt stop ridge 26. A bushing 22 may be sandwiched between the transporter bolt 28 and an interior surface of the bracket hood 24, such that the bushing 22 provides a bearing surface for rotation of the bracket on the hold 28. After passing through the bracket hood 24, the bolt 28 may also pass through a first washer 20, a compression spring 18, and a second washer 12, wherein a tension adjusting lock nut 10 may be engaged with the forward bolt threads 16 to prevent the washers 20, 12 and the compression spring 18 from being disengaged or removed from the transporter bolt 28. The tension adjusting lock nut 10 may also allow for adjustment of the tension of the belt 72, creating a stiffer or more flexible walking/running surface. The compression spring 18 may redistribute the force adjacent to the nearby foot depression to the brackets along an entire length of the rail 74, reducing the maximum force experienced on each bracket. Thus, the compression spring 18 may help redistribute max force adjacent to a user's foot depression to the suspension components along the entire length of the belt 72, greatly reducing the max force on the suspension system directly adjacent to the user's foot depression, where failure would be most likely to occur. A shoulder bushing 14 may be positioned between the transporter bolt 28 and the compression spring 18, wherein the shoulder bushing 14 may provide a bearing surface between the transporter bolt 28 and the compression spring 18. The shoulder bushing 14 may also prevent the compression spring 18 from rubbing on the forward bolt threads 16, causing a crunching sound and, potentially, weakening or damaging the transporter bolt 28. The second washer 12 may prevent rotation of the compression spring 18 from loosening the tension adjusting lock nut 10.

The hooked portion of the transporter bolt 28 may comprise a straight portion and a curved portion, wherein the transporter bolt 28 may attach to a roller 32, such as a Delrin roller, and wherein the roller 32 is configured to engage with the rail 74. Specifically, the roller 32 may comprise an orifice through which the hooked portion may pass, wherein a roller lock nut 34 may engage with the rear bolt threads 36 to secure the roller 32 onto the hooked portion of the transporter bolt 28. In some embodiments, a washer may be positioned between the roller 32 and the roller lock nut 34. The roller 32 may comprise bearings 54 that allow the roller 32 to freely rotate on a straight portion of the hooked portion of the transporter bolt 28. Additionally, the transporter bolt 28 may comprise wing stops to keep a roller bearing 54 from passing onto a curved portion of the bolt 28, causing misalignment of the bearing 54. Thus, the transporter bolt 28 may function to attach the bracket to the roller 32, wherein the roller 32 is configured to roll about rail 74.

Figure 4:
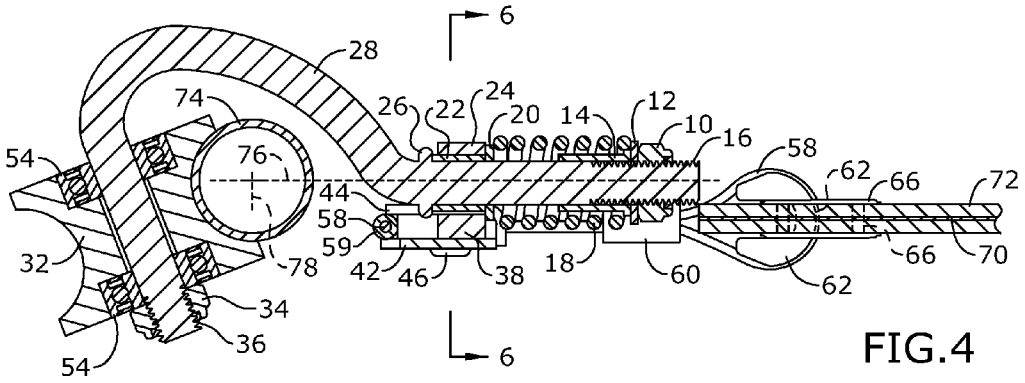
FIG. 4 is a section view of one embodiment of the present disclosure, taken along line 4-4 in FIG. 2.
Figure 5:
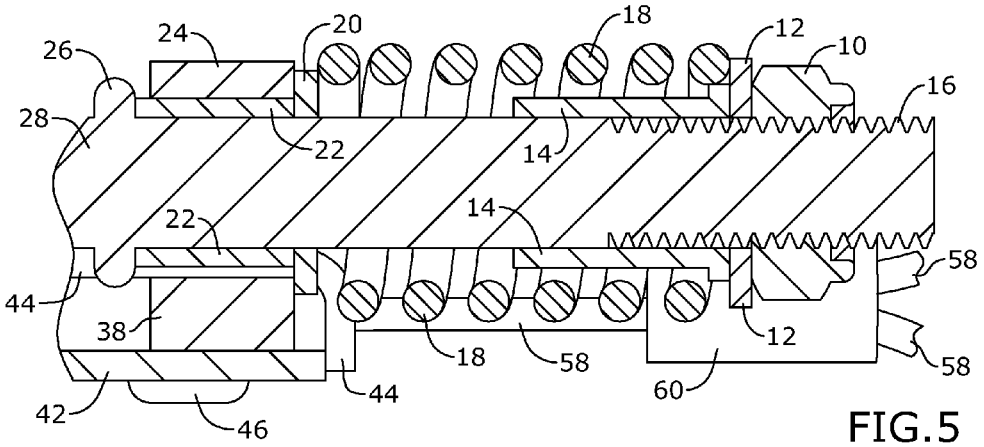
FIG. 5 is a detail section view of one embodiment of the present disclosure.
Figure 6:
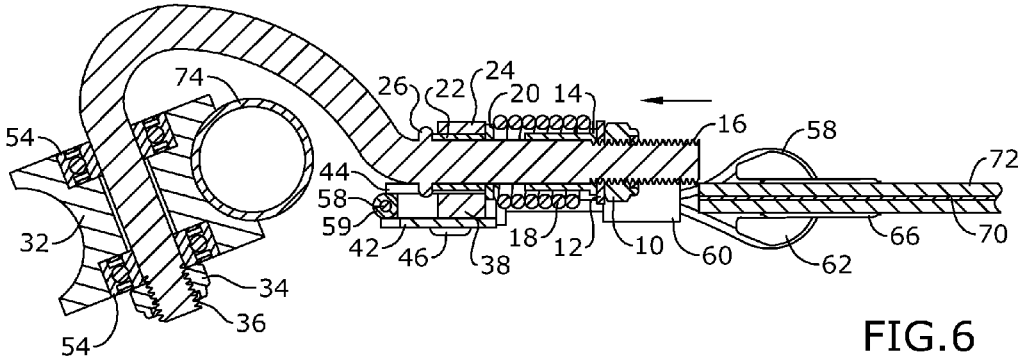
FIG. 6 is a section view of one embodiment of the present disclosure.
Figure 7:
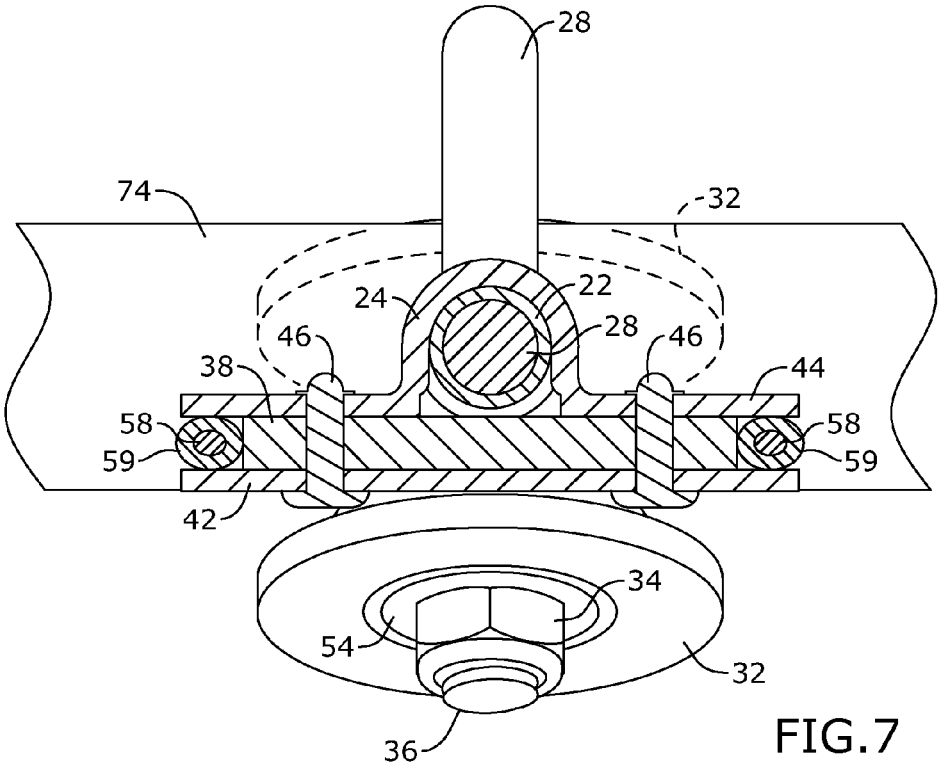
FIG. 7 is a section view of one embodiment of the present disclosure, taken along line 6-6 in FIG. 2.
Figure 8:
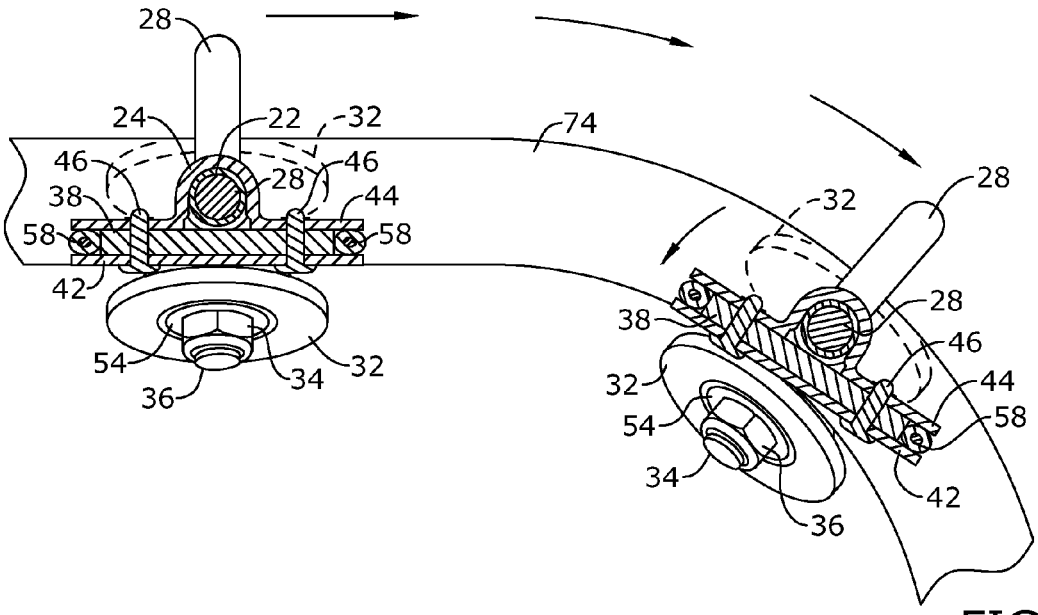
FIG. 8 is a section view of one embodiment of the present disclosure.

In any embodiment, the roller 32 may have a surface with sufficient clearance to slip over the rail 74 and engage with the rail 74. As shown in FIG. 4, a bolt centerline 76 of the transporter bolt 28 may be substantially aligned with a rail centerline 78 of the rail 74. In some embodiments, the angle of bend in the transporter bolt 28 (aka the bolt centerline 76) may align with the rail centerline 78 within about a +/−10° maximum tolerance to prevent failure of the system. For example, the roller 32 may be positioned at an angle of about 110 to about 125 degrees with respect to a center line of the transporter bolt 28 to ride the inside of the rail 74 at the rounded ends and have sufficient clearance.

In embodiments, the positioning of the bracket and the grommets 66 may create a triangular alignment, such as an equilateral triangular alignment with the transporter bolt 28 positioned at the apex of the triangle and the belt 72 between the grommets 66 defining the side of the triangle opposite the apex. The triangular alignment may help evenly distribute weight and forces created by a user walking, running, jogging, or standing on the belt 72, simultaneously reducing damaging to the system and providing a stable running/walking surface.

The components of the system may be made of any desired material. In some embodiments, the belt 72 may comprise a flexible belt material made of corded rubber, similar to the wall of a tire. In some embodiments, the belt 72 may comprise a layered construction, wherein conventional belt material may comprise a first outer layer and a second outer layer, and a Kevlar mesh layer 70, such as a Kevlar mesh cording, may be sandwiched between the first outer layer and the second outer layer to prevent tearing and ripping of the belt 72 out of the grommets 66. In some embodiments, the shoulder bushing 14 may comprise a nylon material, and the compression spring 18 may comprise a titanium die spring. The cable 58 may comprise any suitable cable and, in some embodiments, comprises a stainless steel airline cable with a nylon cable sleeve coating 59. For example, in a particular embodiment, the cable 58 may comprise a 7"×19"×32" stainless steel airline cable.

The orientation and engagement of all components of the system may prevent failure of the components due to the extreme forces required to horizontally suspend the repetitive vertical dynamic forces of, for example, a runner or rehabilitation patient over air.

As mentioned above, the system may be incorporated into a treadmill, wherein the treadmill may comprise conventional features, such as a motor, a system to created elevational changes, user monitors (such as heart monitors), a computer system, and the like.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A system for suspending a walking/running surface over air, the system comprising:

a belt rotationally suspended between a pair of rails, the belt configured to support a user, wherein the belt is not supported by a deck;

a plurality of pairs of grommets spaced along a length of the belt proximate to an edge of the belt;

a bracket attached to a corresponding pair of grommets by a cable;

a transporter bolt extending from the bracket;

a roller rotatably attached to the transporter bolt, wherein the roller is configured to engage with the rail; and a saddle positioned within each grommet, wherein:

each saddle comprises a cable groove configured to accommodate the cable, the saddle being configured to ensure that the cable follows a substantially circular path to insulate the cable from being damaged by the corresponding grommet.

2. The system of claim 1, wherein:

the cable comprises a central portion, a first end, and a second end, the first end passing through a first grommet of the pair of grommets and the second end passing through a second grommet of the pair of grommets;

each of the first end and the second end is formed into a loop using a cable crimp; and the central portion of the cable engages with the bracket.

3. The system of claim 1, wherein:

the bracket comprises a bracket insert sandwiched between a top bracket portion and a lower bracket portion;

the top bracket portion, the bracket insert, and the lower bracket portion are held together by a pair of rivets; and a bracket hood extends from a surface of the top bracket portion, the bracket hood defining through which a portion of a transporter bolt is configured to pass.

4. The system of claim 3, wherein:

the transporter bolt comprises a substantially straight portion and a rounded hook portion extending from the substantially straight portion;

a bolt stop ridge defines a demarcation between the substantially straight portion and the rounded hook portion;

a end of the substantially straight portion distal from the hooked portion comprises forward end bolt threads; and an end of the hooked portion distal from the substantially straight portion comprises rear bold threads.

5. The system of claim 4, wherein:

the substantially straight portion of the transporter bolt passes through the bracket hood, a first washer, a compression spring, a second washer, and a tension adjusting lock nut, in order, wherein the tension adjusting lock nut is configured to engage with the forward bolt threads;

a bushing is sandwiched between the transporter bolt and an interior surface of the bracket hood; and a shoulder bushing is positioned between the transporter bolt and the compression spring.

6. The system of claim 4, wherein:

the hooked portion of the transporter bolt comprises a straight portion with rear bolt threads and a curved portion; and the roller comprises an orifice through which the hooked portion passes, the roller being secured to the hooked portion by a roller lock nut engaged with the rear bolt threads.

7. The system of claim 1, wherein a bolt centerline of the transporter bolt is aligned with a rail centerline of the rail within about a +/−10° maximum tolerance to prevent failure of the system.

8. A treadmill comprising a running/walking surface rotatably suspended over air, the treadmill comprising:

a belt rotationally suspended between a pair of rails, the belt configured to support a user;

a plurality of pairs of grommets spaced along a length of the belt proximate to an edge of the belt;

a bracket attached to a corresponding pair of grommets by a cable, wherein the bracket and the pair of grommets are positioned in a triangular relationship;

a transporter bolt extending from the bracket; and a roller rotatably attached to the transporter bolt, wherein the roller is configured to engage with the rail, wherein the belt is not supported by a deck.

* * * * *